US007213273B2

(12) United States Patent
Wang

(10) Patent No.: US 7,213,273 B2
(45) Date of Patent: May 8, 2007

(54) HIGH PRESSURE PLUNGER

(75) Inventor: Long-Sheh Wang, Chia Yi (TW)

(73) Assignee: Chntuo Industrial Co., Ltd., Chia Yi (TW)

( * ) Notice: Subject to any disclaimer, the term of this patent is extended or adjusted under 35 U.S.C. 154(b) by 185 days.

(21) Appl. No.: 11/152,047

(22) Filed: Jun. 15, 2005

(65) Prior Publication Data

US 2006/0282941 A1 Dec. 21, 2006

(51) Int. Cl.
*E03D 9/00* (2006.01)

(52) U.S. Cl. ..... 4/255.06; 4/255.04; 4/255.08; 4/255.01

(58) Field of Classification Search ... 4/255.01–255.12
See application file for complete search history.

(56) References Cited

U.S. PATENT DOCUMENTS

| | | | | | |
|---|---|---|---|---|---|
| 357,717 | A * | 2/1887 | Lawless | 4/255.03 |
| 446,283 | A * | 2/1891 | Danaher | 4/255.03 |
| 477,808 | A * | 6/1892 | Lawless | 4/255.03 |
| 1,734,206 | A * | 11/1929 | Fisch | 4/255.05 |
| 1,994,526 | A * | 3/1935 | McCloskey | 4/255.06 |
| 5,524,296 | A * | 6/1996 | Leighton | 4/255.05 |
| 6,032,301 | A * | 3/2000 | Wang | 4/255.06 |
| 6,393,625 | B1 * | 5/2002 | Tsai | 4/255.02 |
| 6,775,857 | B2 * | 8/2004 | Hughes et al. | 4/255.04 |
| 6,922,854 | B2 * | 8/2005 | Allenbaugh et al. | 4/255.11 |
| 7,073,211 | B1 * | 7/2006 | Wu | 4/255.02 |

* cited by examiner

*Primary Examiner*—Khoa D. Huynh
(74) *Attorney, Agent, or Firm*—Rosenberg, Klein & Lee

(57) ABSTRACT

A plunger includes a lever, a pipe, a rod passed through an axial hole of the pipe, a covering member, and a spring; the rod will be upwards displaced when the lever is pivoted upwards; the rod has a passage therein, and a head at an upper end for connection with an air pump; the covering member has a neck, and an outlet on a lower side; the pipe is inserted in the neck; two airtight rings are secured on an inner side of the neck; the rod is normally biased to a lowermost position by the spring; the lower end of the rod will block the outlet, and the passage will communicate with inside of the covering member when the rod is in lowermost position; when the lever is pivoted upwards, high-pressure air will escape through the outlet to push a blockage in a drain tube of a sink.

4 Claims, 6 Drawing Sheets

HIGH PRESSURE PLUNGER

BACKGROUND OF THE INVENTION

1. Field of the invention

The present invention relates to a high pressure plunger for use on drain, sink, and toilet, more particularly one, which is structured in such a way as to be suitable for use together with an air pump to get rid of a blockage with high-pressure air.

2. Brief Description of the Prior Art

A simplest conventional plunger includes a handle, and an inverted rubber bowl joined to a lower end of the handle. A blockage in a pipe is loosened, and got rid of by means of exerting suction and air pressure on the blockage repeatedly with the plunger. However, suction and air pressure producible with the plunger isn't very great, and it is possible that a blockage remains in a pipe after having been slightly moved with the plunger.

The inventor of the present invention taught an improvement on a plunger, and was granted U.S. Pat. No. 6,032,301 for making this improvement. The plunger includes an upper base, a pressure ball under the upper base, a correlative tubular shaft extending vertically through the pressure ball, a handle pivotally connected with an upper end of the correlative tubular shaft, a connecting rod connects to the correlative shaft, and a lower end stopper threadedly connected with the lower end of the connecting rod. The pressure ball can store air supplied by an air pump or compressor through an air inlet. The handle can be operated to move the correlative tubular shaft away from the upper opening of the connecting rod, thus letting the air stored in the pressure ball flow through the correlative shaft, the connecting rod and the lower end stopper into a clogged pipe or drain for clearing passage with a large force of pressured air.

However, because air stored in the pressure ball will travel a long distance through a narrow passage before it flows through the lower end stopper, and because the opening of the lower end stopper is small, the plunger still can't get rid of a blockage in a pipe or toilet effectively.

SUMMARY OF THE INVENTION

It is a main object of the invention to provide an improvement on a plunger to overcome the above-mentioned problem. The plunger of the invention includes a lever, a pipe, a rod passed through an axial hole of the pipe, a covering member, and a spring. The rod is joined to the lever such that it will be upwards displaced when the lever is pivoted upwards. The rod has a passage therein, and a head at an upper end for connection with an air pump. The covering member has a neck, and an outlet on a lower side. The pipe is inserted in the neck at a lower end. Two airtight rings are secured on an inner side of the neck. The rod is normally biased to a lowermost position by the spring. The lower end of the rod will block the outlet, and the passage will communicate with inside of the covering member when the rod is in the lowermost position. When the lever is pivoted upwards, high-pressure air will escape through the outlet of the covering member to push a blockage in a drain tube of a sink.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
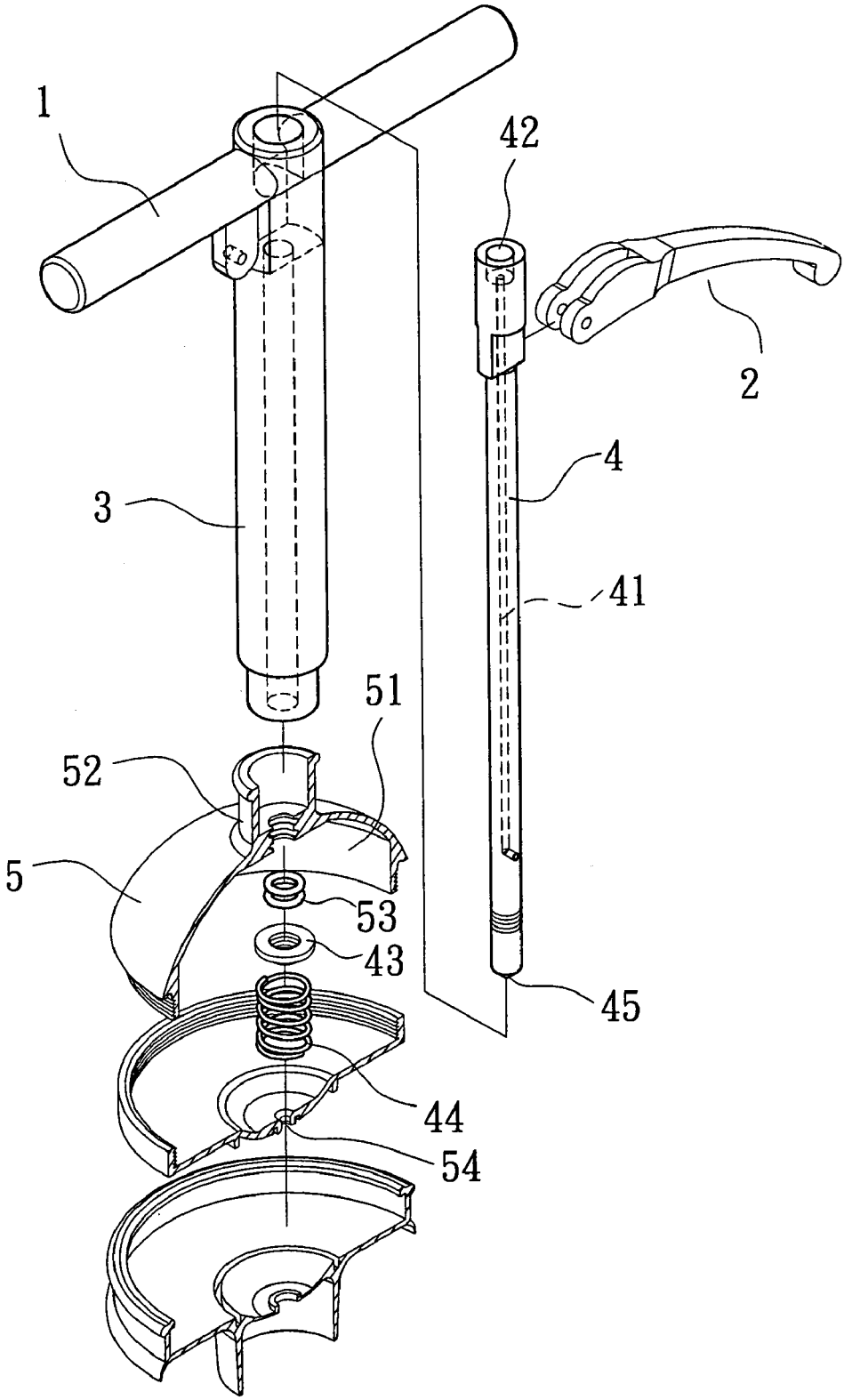
FIG. 1 is an exploded perspective view of the first preferred embodiment of a plunger according to the present invention.
Figure 2:
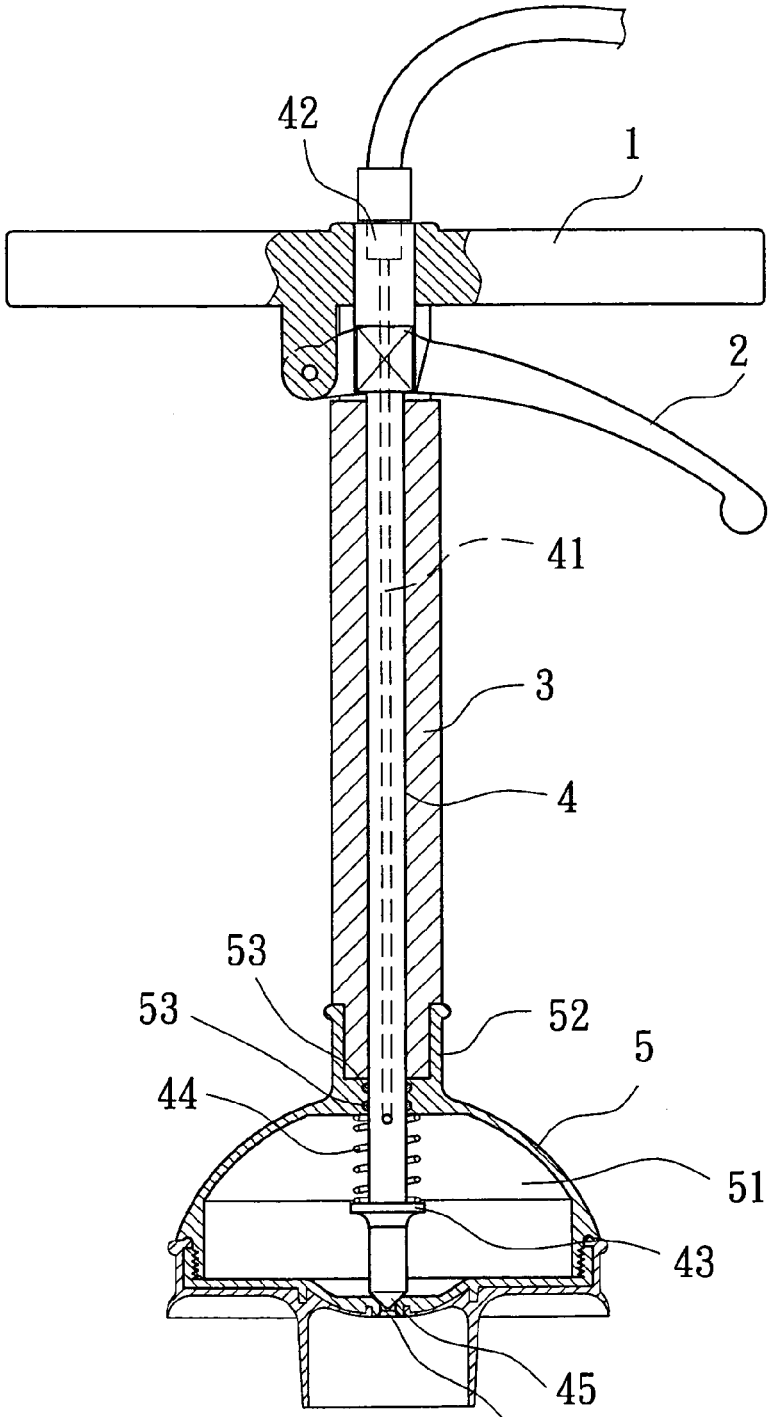
FIG. 2 is a vertical section of the first preferred embodiment.

Referring to FIGS. 1 and 2, a first preferred embodiment of a plunger in the present invention includes a supporting member 1, a lever 2, a pipe 3, a connecting rod 4, and a covering member 5.

The lever 2 is positioned under, and pivoted to the supporting member 1. The pipe 3 is passed through, and joined to the supporting member 1 at an upper end thereof.

The connecting rod 4 has a passage 41 therein, a cone-shaped tail end 45, and a coupling head 42 joined to an upper end thereof for connection with an air pump. The passage 41 communicates with inside of the coupling head 42, and it has an outlet portion, which is a certain distance from the cone-shaped tail end 45 of the connecting rod 4. The connecting rod 4 is passed through an axial hole of the pipe 3 with the lower end thereof projecting out from a lower end of the pipe 3, and it is connected to the lever 2 such that it will be upwards displaced relative to the pipe 3 when the lever 2 is pivoted upwards.

The covering member 5 has a holding room 51 therein, and it has a neck portion 52 on an upper side thereof, and an air outlet hole 54 on a lower side. The neck portion 52 has an axial hole in communication with the holding room 51, and two airtight rings 53 secured on an inner side thereof.

In assembly, the covering member 5 is securely joined to the lower end of the pipe 3 at the neck portion 52 thereof, and the connecting rod 4 is passed through the neck portion 52. And, a spring 44 is positioned around the connecting rod 4 in the holding room 51, and a stopping ring 43 is secured around a portion of the connecting rod 4 that is between the outlet portion 45 of the passage 41 and the cone-shaped tail end 45; thus, the spring 44 can't fall off the connecting rod 4, and the connecting rod 4 is normally biased to a lowermost position by means of the spring 44; when the connecting rod 4 is biased to the lowermost position, the cone-shaped tail end 45 will block the air outlet hole 54 of the covering member 5 to prevent air from traveling through the air outlet hole 54, and the outlet portion of the passage 41 will be under both of the airtight rings 53, allowing air to travel into the holding room 51 from the passage 41. When the connecting rod 4 is displaced away from the lowermost position by means of pivoting the lever 2, the outlet portion of the passage 41 will be between the airtight rings 53, and air can't travel into the holding room 51 of the covering member 5 from the passage 41.

Figure 3:
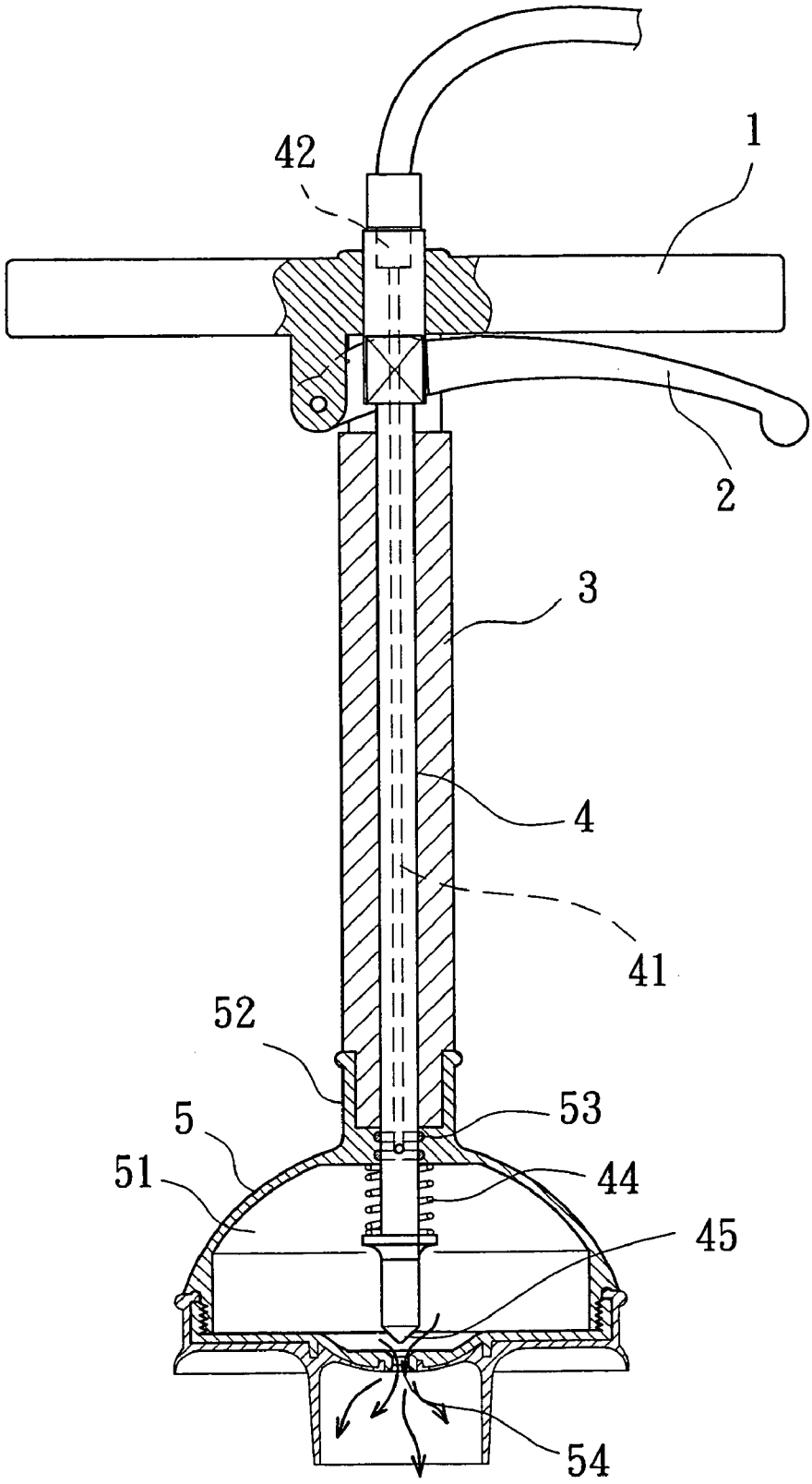
FIG. 3 is a vertical section of the first embodiment being in use.

To use the plunger, referring to FIG. 3, first an air pump is connected to the coupling head 42 of the connecting rod 4, and the plunger is positioned such that the covering member 5 covers a plughole of a sink. Next, air is pumped into the holding room 51 of the covering member 5 through the passage 41 of the connecting rod 4 such that the holding room 51 contains high-pressure air. And, the lever 2 is pivoted upwards such that the connecting rod 4 moves away from the outlet hole 54 of the covering member 5, and the cone-shaped tail end 45 no longer blocks the outlet hole 54. Finally, the lever 2 is released so that the connecting rod 3 is displaced to the lowermost position by the spring 44, and seals the outlet hole 54 again, and air is allowed to travel into the holding room 51 from the outlet portion of the passage 41 again. Thus, the high-pressure air in the holding room 51 travels through the plughole of the sink, and pushes a blockage formed in a drain tube connected to the plughole; the lever 1 is pivoted upwards and released repeatedly until the blockage is got rid of.

Figure 4:
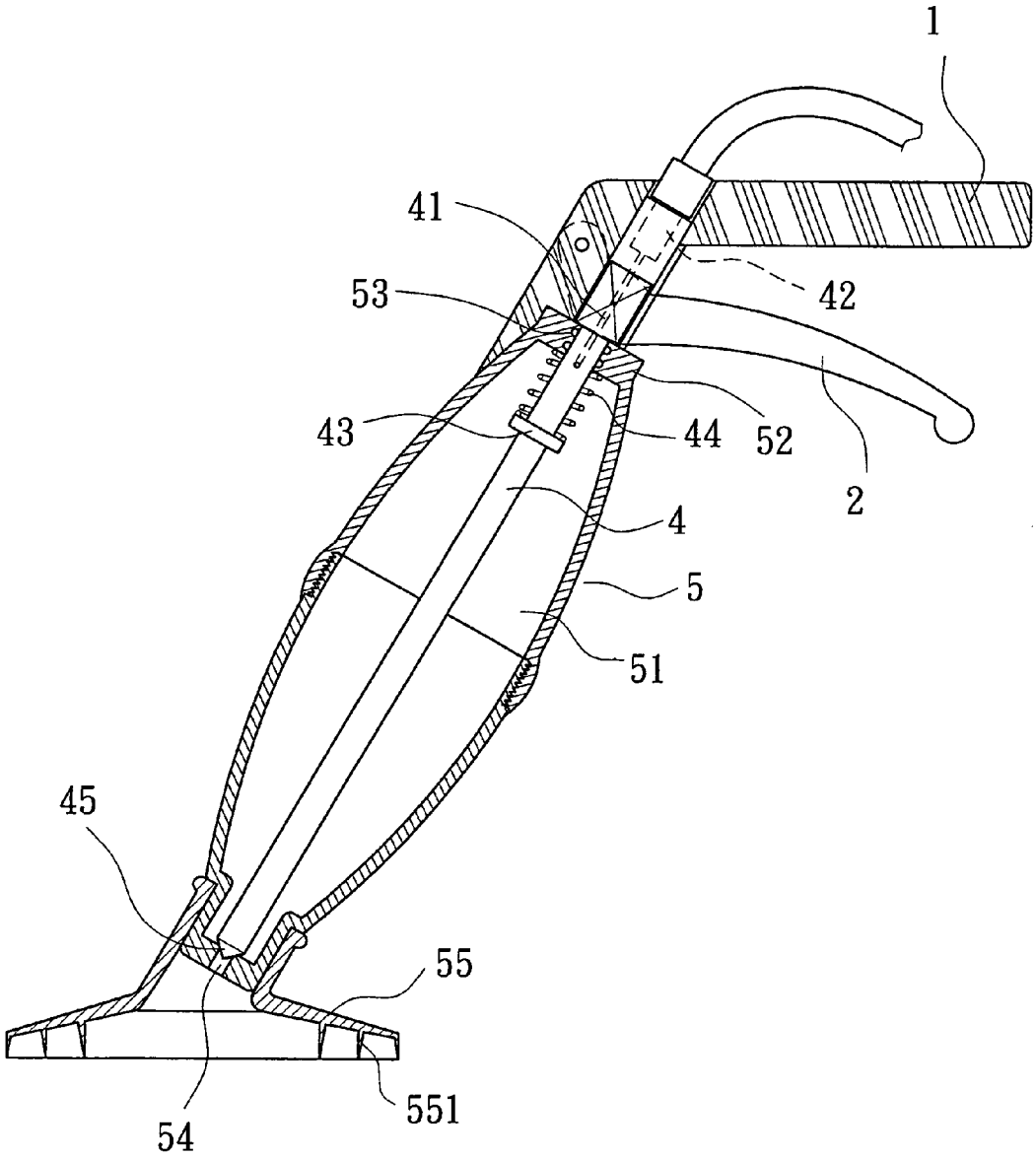
FIG. 4 is a vertical section of the second preferred embodiment.
Figure 5:
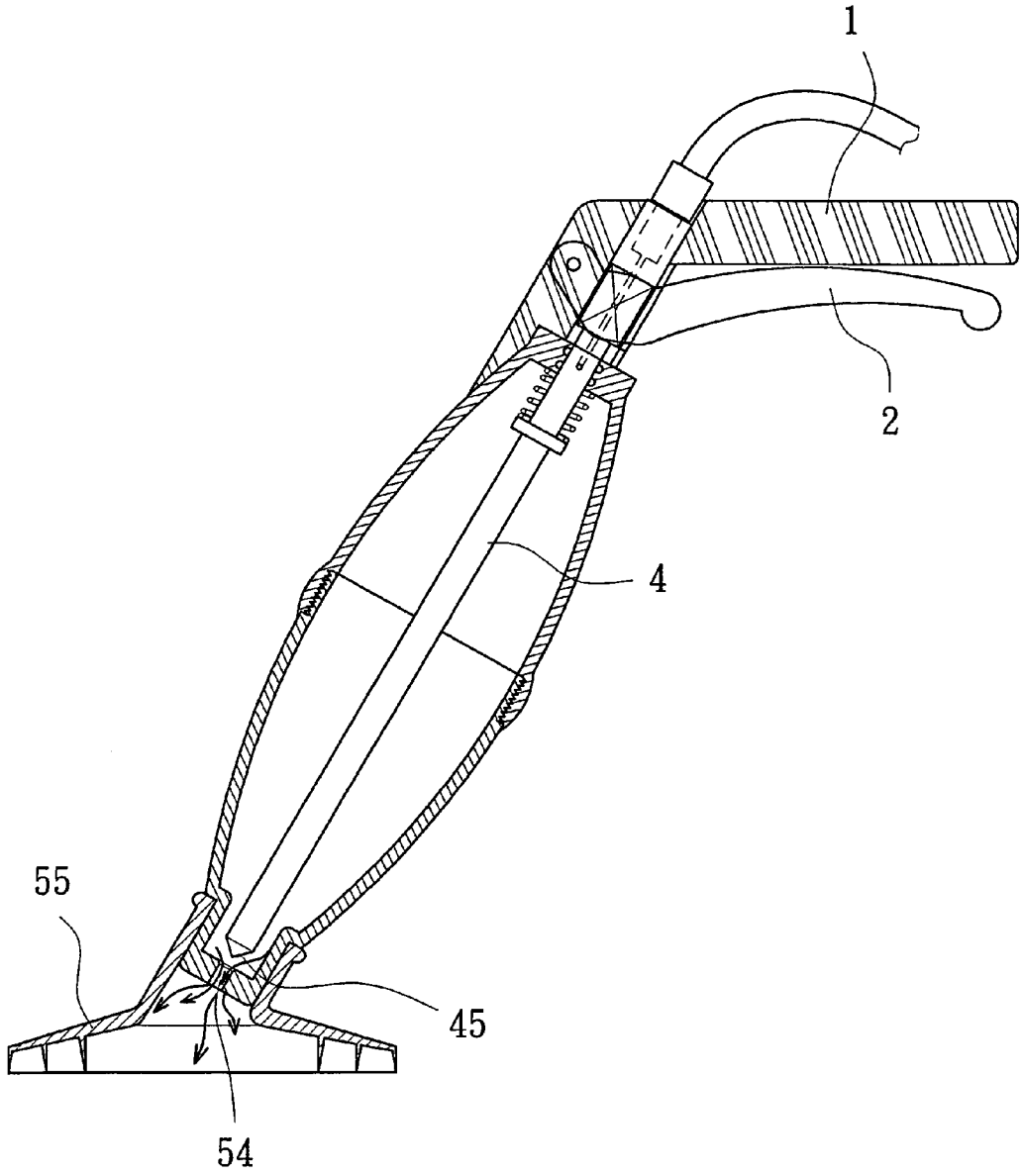
FIG. 5 is a vertical section of the second embodiment being used.

Referring to FIGS. 4 and 5, a second preferred embodiment of the invention includes a supporting member 1, a lever 2, a connecting rod 4, and a covering member 5. The lever 2 is positioned under, and pivoted to the supporting member 1. The connecting rod 4 has a passage 41 therein, a cone-shaped tail end 45, and a coupling head joined to an upper end thereof for connection with an air pump. The passage 41 communicates with inside of the coupling head, and it has an outlet portion, which is between upper and lower ends of the connecting rod 4. The connecting rod 4 is connected to the lever 2 such that it will be upwards displaced when the lever 2 is pivoted upwards. The covering member 5 has a holding room therein, a through hole (not numbered) on an upper end, and an air outlet hole 54 on a lower end. Two airtight rings 53 are secured in the upper through hole of the covering member 5.

In assembly, the connecting rod 4 is passed through the upper through hole of the covering member 5, and a spring 44 is positioned around the connecting rod 4, and a stopping ring 43 is secured around the connecting rod 4, under the spring 44; thus, the spring 44 can't fall off the connecting rod 4, and the connecting rod 4 is normally biased to a lowermost position by means of the spring 44 such that the cone-shaped tail end 45 blocks the air outlet hole 54 of the covering member 5; when the connecting rod 4 is biased to the lowermost position, the outlet portion of the passage 41 will be under both of the airtight rings 53, allowing air to travel into the covering member 5 from the passage 41. When the connecting rod 4 is displaced away from the lowermost position, the outlet portion of the passage 41 will be between the airtight rings 53, and air can't travel into the covering member 5 from the passage 41. Thus, the second preferred embodiment can be used in the same way as the first preferred embodiment to get rid of a blockage in a pipe.

Furthermore, the invention is equipped with a supplementary covering member 55, which is made of rubber, and joined to the lower end of the covering member 5, and which has several annular wall portions 551 on a lower side, such that when the plunger is used to get rid of a blockage in a pipe of a sink, there will certainly be an airtight joint between the plunger and the sink.

Figure 6:
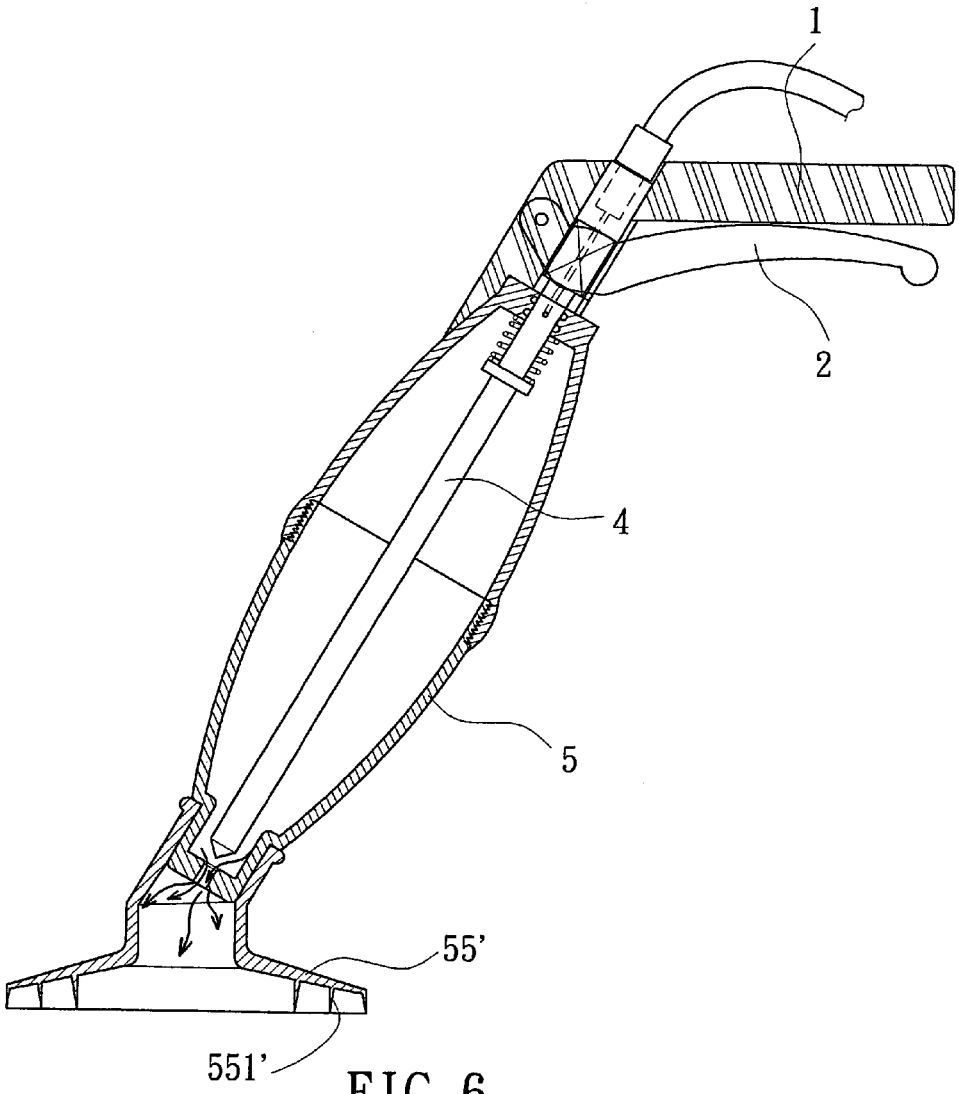
FIG. 6 is a vertical section of the second embodiment equipped with another shape of rubber supplementary covering member.

Referring to FIG. 6, another supplementary covering member 55' is provided for use instead of the one 55, which has a slightly different shape from the one 55.

From the above description, it can be seen that according to the present invention, high pressure air is stored next to the outlet hole of the covering member, and will arrive at a blockage in a pipe rapidly after it is released, the drawback of the prior plunger as described in Background is overcome.

What is claimed is:

1. An improvement on a plunger, comprising a supporting member;

a lever positioned under, and pivoted to the supporting member;

a pipe passed through, and joined to the supporting member at an upper end thereof;

a connecting rod; the connecting rod being passed through an axial hole of the pipe with a lower end thereof projecting out from a lower end of the pipe; the connecting rod being connected to the lever such that it will be upwards displaced relative to the pipe when the lever is pivoted upwards; the connecting rod having a coupling head joined to an upper end thereof for connection with an air pump; the connecting rod having a passage therein, which communicates with inside of the coupling head, and which has an outlet portion; the connecting rod having a cone-shaped lower end; the connecting rod having a stopping ring secured around a portion thereof that is between the outlet portion of the passage and the cone-shaped lower end;

a covering member having a holding room; the covering member having a neck portion on an upper side thereof, and an air outlet hole on a lower side; the neck portion having an axial hole in communication with the holding room; the covering member being securely joined to the lower end of the pipe at the neck portion thereof with the connecting rod being passed through the axial hole of the neck portion;

two airtight rings secured on an inner side of the neck portion of the covering member; and a spring positioned between the neck portion of the covering member and the stopping ring secured on the connecting rod for biasing the connecting rod downwards;

the connecting rod being going to be biased to a lowermost position by means of the spring when the lever isn't used; the cone-shaped tail end being going to block the air outlet hole of the covering member when the connecting rod is biased to the lowermost position; the outlet portion of the passage being going to be under both of the airtight rings, allowing air to travel into the holding room from the passage, when the connecting rod is biased to the lowermost position; the outlet portion of the passage being going to be between both of the airtight rings when the connecting rod is displaced upwards away from the lowermost position by means of pivoting the lever upwards; air being going to be stopped from traveling into the covering member from the passage when the outlet portion of the passage is between both of the airtight rings.

2. An improvement on a plunger, comprising a supporting member;

a lever positioned under, and pivoted to the supporting member;

a connecting rod; the connecting rod being connected to the lever such that it will be upwards displaced relative to the pipe when the lever is pivoted upwards; the connecting rod having a coupling head joined to an upper end thereof for connection with an air pump; the connecting rod having a passage therein, which communicates with inside of the coupling head; the passage having an outlet portion; the connecting rod having a cone-shaped lower end; the connecting rod having a stopping ring secured around a portion thereof that is between the outlet portion of the passage and the cone-shaped lower end;

a covering member having a holding room; the covering member having a through hole on an upper side thereof; the covering member having an air outlet hole on a lower side;

two airtight rings secured in the upper through hole of the covering member; and a spring positioned between the neck portion of the covering member and the stopping ring secured on the connecting rod for biasing the connecting rod downwards;

the connecting rod being passed through the upper through hole of the covering member; the connecting rod being going to be biased to a lowermost position by means of the spring when the lever isn't used; the cone-shaped tail end of the connecting rod being going to block the air outlet hole of the covering member when the connecting rod is biased to the lowermost position; the outlet portion of the passage being going to be under both of the airtight rings, allowing air to travel into the holding room from the passage, when the connecting rod is biased to the lowermost position; the outlet portion of the passage being going to be between both of the airtight rings when the connecting rod is displaced upwards away from the lowermost position by means of pivoting the lever upwards; air being going to be stopped from traveling into the covering member from the passage when the outlet portion of the passage is between both of the airtight rings.

3. The plunger as claimed in claim 1, wherein a supplementary covering member is joined to the lower end of the covering member, which supplementary covering member is made of rubber, and has a plurality of annular wall portions on a lower side.

4. The plunger as claimed in claim 2, wherein a supplementary covering member made of rubber is joined to the lower end of the covering member; the supplementary covering member having a plurality of annular wall portions on a lower side thereof.

* * * * *